US006860474B2

(12) United States Patent
Blakley et al.

(10) Patent No.: US 6,860,474 B2
(45) Date of Patent: Mar. 1, 2005

(54) AGITATOR AND DRIVE APPARATUS AND METHOD

(75) Inventors: Robert Blakley, Rochester, NY (US); Andrew Creathorn, Macedon, NY (US)

(73) Assignee: SPX Corporation, Charlotte, NC (US)

( * ) Notice: Subject to any disclaimer, the term of this patent is extended or adjusted under 35 U.S.C. 154(b) by 61 days.

(21) Appl. No.: 10/357,350

(22) Filed: Feb. 4, 2003

(65) Prior Publication Data

US 2004/0130042 A1 Jul. 8, 2004

Related U.S. Application Data

(60) Provisional application No. 60/438,008, filed on Jan. 6, 2003.

(51) Int. Cl.[7] ..... B01F 3/04
(52) U.S. Cl. ..... 261/87; 366/102; 366/331
(58) Field of Search ..... 261/87, 91, 93; 366/102, 331, 347

(56) References Cited

U.S. PATENT DOCUMENTS

| | | | | | |
|---|---|---|---|---|---|
| 2,193,934 | A | * | 3/1940 | Moores | 261/32 |
| 2,826,401 | A | * | 3/1958 | Peters | 261/87 |
| 3,108,146 | A | * | 10/1963 | Gross | 261/24 |
| 4,100,610 | A | * | 7/1978 | Johnston et al. | 366/102 |
| 4,249,828 | A | * | 2/1981 | Condolios | 366/102 |
| 4,844,816 | A | * | 7/1989 | Fuchs et al. | 210/758 |
| 6,439,756 | B1 | * | 8/2002 | Forschner et al. | 366/102 |
| 2002/0172092 | A1 | * | 11/2002 | Reeder et al. | 366/270 |

* cited by examiner

*Primary Examiner*—Scott Bushey
(74) *Attorney, Agent, or Firm*—Baker & Hostetler LLP

(57) ABSTRACT

An agitator drive apparatus for agitating and injecting gas into a liquid in a mixing vessel. The apparatus includes a first and second housing coupled to one another along with a shaft having a first and second end that is rotatably coupled to the first housing and extends from the first housing into the second housing. The shaft includes an inner bore that extend from the second end at least partially to the first end. The shaft also includes a plurality of air ports in communication with the inner bore.

9 Claims, 2 Drawing Sheets

AGITATOR AND DRIVE APPARATUS AND METHOD

PRIORITY

This application claims priority to the provisional U.S. patent application entitled, AGITATOR DRIVE APPARATUS AND METHOD, filed Jan. 6, 2003, having a Ser. No. 60/438,008, the disclosure of which is hereby incorporated by reference.

FIELD OF THE INVENTION

The present invention relates to an agitator drive and gas injection apparatus and method. More particularly, the present invention relates to an improved apparatus and method for injecting or dispersing gas or other fluids into an agitator or mixer. The invention is useful, for example, in chemical and biological processes that require the introduction of gas through the agitator shaft into the agitated liquid.

BACKGROUND OF THE INVENTION

In chemical or biological processes such as waste treatment and Flue Gas Desulphurization, it is common for these processes to be carried out in a stirred vessel where gas, such as oxygen or an oxygen containing gas, is injected into the agitated liquid through a submerged agitator. These aforementioned processes are oftentimes utilized by municipalities and industry to treat waste and to produce chemicals and chemical byproducts, wherein the process requires the gas to be introduced to the liquid simultaneously as it is being agitated. The gas is commonly compressed and/or pressurized gas injected into the agitated liquid through the agitator drive and agitator via a sparge arrangement.

Current methods and apparatuses for the injection of gas into an agitated liquid via a submerged agitator require special construction, including specialized parts and components that tend to increase manufacturing and operating costs while decreasing agitator reliability.

For example, conventional methods for injecting gas into an agitated liquid involve passing compressed gas through the drive components of the agitator, including the gear drive, the agitator or mixer shaft, and the shaft support bearings and/or flexible couplings.

Current agitator drive/gas injection technology typically includes a large compressor connected to a rotary joint of the agitator drive via stationary piping. The compressor generates compressed gas or air which is usually high in temperature due to the compression, enabling it to overcome the static head pressure of the liquid column in the agitator shaft and travel to the delivery points of the sparge arrangement located on the submerged agitator. The rotary joint is typically connected to the gear drive of the agitator through a specialized connection. Because present methods of injecting gas into a liquid entail delivery through the agitator shaft, the gear drive of the agitator must have a large shaft bore. This is required to allow sufficient gas flow at minimum pressure drop as well as providing adequate spacing for placement of insulation and a corrosion resistant liner. The insulation and liner function to promote adequate service life by keeping the bearing and the gear drive lubricants cool.

Current gas injection apparatuses also include flexible couplings that connect the agitator shaft to the gear drive along with specialized bearings for supporting the shaft which require additional mounting considerations such as hydraulic nuts that increase the cost of manufacture. The specialized bearings must accommodate varying bearing clearances and tolerances due to shaft temperature change. In addition, current gas injection apparatuses require use of a shaft seal to prevent gas in the vapor space of the mixing vessel from escaping into the atmosphere.

The aforementioned special construction of the current agitator drive/gas injection apparatuses is due in part to the elevated temperature of the compressed gas, which often times reaches temperatures of 250° F. or higher. At these elevated temperatures, commonly used lubricants for gear drives, flexible couplings and bearings breakdown more rapidly, requiring increased maintenance to prevent premature failure.

For this reason, the components of current gas injection apparatuses are oversized and the apparatuses are specially configured and use special lubricants in the seals and couplings along with using insulation and corrosion liners to accommodate the high gas temperatures. Furthermore, the drive gear bearings must be oversized, require special lubrication, maintenance intervals and specialized assembly settings to accommodate the varying operating clearances between the bearings and the drive shaft, that result from the elevated gas temperature.

The present apparatuses also attempt to address the elevated gas temperatures by cooling the gas prior to delivering it to the agitator. The gas can be cooled by natural convection from the distribution piping, it may be cooled by a specialized cooler. The specialized cooler, however, oftentimes requires significant outlays in terms of manufacturing cost and operating cost.

Accordingly, it is desirable to provide a method and apparatus for effectuating improved gas injection through an agitator drive which provides improved agitator reliability while reducing the need for specialized components and construction and therefore reducing manufacturing and operating costs.

SUMMARY OF THE INVENTION

The foregoing needs are met, at least in part, by the present invention where, in one aspect, an agitator drive apparatus is provided for use with a mixing vessel having a first housing and a second housing coupled to the first housing. The apparatus also has a shaft having a first end and a second end, wherein the shaft is rotatably coupled to the first housing and the shaft extends from the first housing into the second housing. The shaft includes an inner bore that extends from the second end of the shift at least partially to the first end of the shaft. The shaft additionally has a plurality of air ports in communication with the inner bore. The air ports are positioned on a portion of the shaft that is disposed within the second housing.

In another aspect of the invention, an agitator drive apparatus is provided for use with a mixing vessel having a housing and a sleeve coupled to the housing. The apparatus includes a shaft having a first end and a second end wherein the shaft is rotatably coupled to the housing and it extends from the housing into the sleeve. The shaft includes an inner bore that extends from the second end of the shaft at least partially to the first end of the shaft. The shaft additionally has a plurality of air ports in communication with the inner bore of the shaft. The air ports are positioned on a portion of the shaft that is disposed within the sleeve.

In accordance with yet another aspect of the invention, a method for agitating a fluid and injecting a gas into the fluid is provided comprising rotating a shaft coupled to a liquid agitator, the shaft having a first end, a second end and an inner bore, wherein the inner bore extends from the second end at least partially to said first end, the shaft being coupled to a first housing and extending from the first housing to a second housing, wherein the shaft includes a plurality of air ports positioned on a portion of the shaft that is located in the second housing wherein the air ports are in communication with the inner bore; and delivering gas to the second housing so that the gas enters the air ports and the bore.

In accordance with another aspect of the present invention, an agitator drive apparatus is provided for use with a mixing vessel having a first housing means and a second housing means coupled to the first housing means. The apparatus additionally includes an agitator drive means having a first end and a second end, wherein the drive means is rotatably coupled to the first housing means. The agitator drive means extends from the first housing means into the second housing means and has an inner bore. The inner bore extends from the second end of the agitator drive means at least partially to the first end of the agitator drive means. The agitator drive means additionally includes air ports positioned on a portion of the agitator drive means disposed within the second housing means. The air ports are in communication with the inner bore.

There has thus been outlined, rather broadly, several features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

The present invention provides an apparatus for driving a liquid agitator and injecting gas or air into the agitated liquid. In the embodiments depicted, the agitator drive apparatuses are utilized in combination with an industrial mixer and are shown in a vertical axis typical of top entering mixers. It should be understood, however, that the present invention is not limited in its use to top entering mixers but can be used, for example, with bottom entering or side entering mixers.

Figure 1:
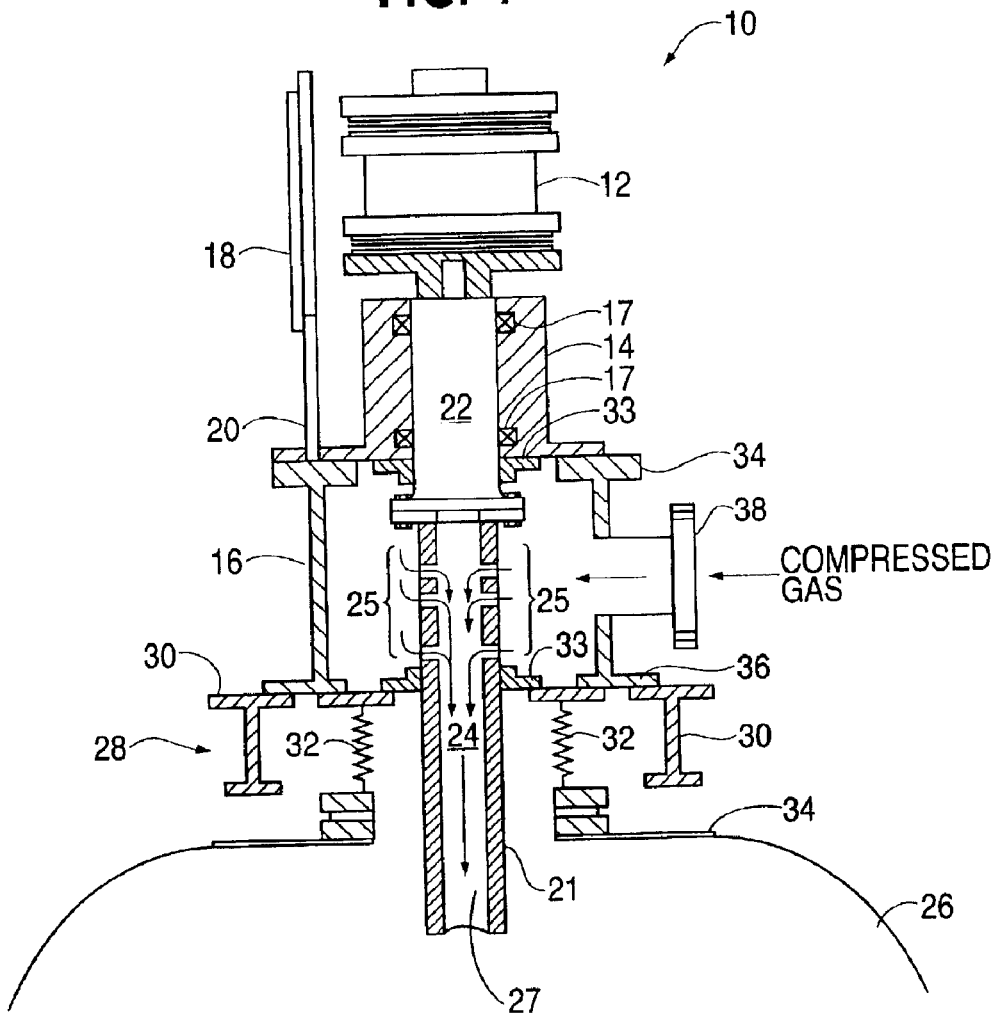
FIG. 1 is a partial cross-sectional view of an agitator and gas injection apparatus in accordance with an embodiment of the present invention.

Referring now to the figures, wherein like reference numerals indicate like elements, FIG. 1 depicts a partial cross-sectional view of an agitator drive and gas injection apparatus 10, in accordance with an embodiment of the invention. The drive apparatus 10 includes a flexible coupling 12 connected to a spindle shaft/bearing assembly 14 that is connected to a pressure housing 16. The flexible coupling 12 and spindle shaft bearing assembly 14 are preferably disposed within the pedestal cover 18 of the pedestal 20. The spindle shaft/bearing assembly 14 includes a pair of support bearings 17. The apparatus 10 additionally includes a shaft 21 that is disposed within the spindle shaft/bearing assembly 14 and the pressure housing 16. The shaft 21 includes a first section 22 that is connected to the coupling 12 and rotatably mounted to the spindle shaft/bearing assembly 14 via the pair of bearings 17. The first section 22 extends into the pressure housing 16. The shaft 21 also includes a second section 24 that is disposed within the pressure housing 16 and extends from the housing 16 into the mixer vessel 26. The second section 24 has an inner bore 27 that preferably extends the length of the second portion for the transfer and delivery of gas or air to a sparge arrangement located on the liquid agitator (not pictured) that is connected to the second section 24. Alternatively, the shaft 21 can be a single, unitary piece wherein the inner bore 27 of the shaft 21 extends from the vessel 26 at least partially vertical towards the coupling 12 and shaft/bearing assembly 14.

The second section 24 of the shaft 21 is disposed within the pressure housing 16 and extends into the mixing vessel 26 and preferably has a liquid agitator having a sparge arrangement for gas injection connected thereto. As illustrated in FIG. 1, the second section 24 has a plurality or series of air ports or perforations 25 that allow for the compressed gas or air to pass from the housing 16 to enter the inner bore 27 through the perforations 25 and proceed to the agitator.

As illustrated in FIG. 1, the agitator apparatus 10 also has an attachment assembly 28 for attaching the apparatus 10 to the mixing vessel 26. The attachment assembly 28 includes mounting beams 30 and bellows 32 that attach to the stud pad 34 of the mixing vessel 26. The bellows 32 are preferably positioned between the mixing vessel and the housing 16 and reduce the need for close tolerance precision as required by current agitator designs, and attach the housing 16 to the mixing vessel 26. Alternatively, other embodiments included in the present invention may be directly attached to the stud pad 34 of the mixing vessel 26 and not utilize an attachment assembly 28.

As depicted in FIG. 1, the pressure housing 16 sealingly couples to the spindle shaft/bearing assembly 14 and the attachment assembly 28 via commercially available non-contact seals 33 and flanges 34, 36. The seals 33 are preferably gas seals. The pressure housing 16 may alternatively use O-rings or other contact sealing means known in the art. Preferably, the housing 16 has an upper flange 34 that attaches to the spindle shaft/bearing assembly 14 and a lower flange 36 that attaches the housing to attachment assembly 28, however other suitable attachment means known in the art may be utilized. The housing 16 additionally includes an air inlet 38 that is coupled to the compressed air source (not pictured), preferably by flange attachment.

The gas seals 33 combine with the pressure housing 16 to create an annular sealed space around the second section of the shaft 21 while also providing a seal between the vessel 26 and the shaft 21. Preferably, use of the pressure housing 16 eliminates the need for a separate shaft seal. Alternatively, a separate shaft seal may be used in combination with the pressure housing 16. The pressure housing 16 functions to reduce the likelihood of air or gas from the compressor, leaking into the mixing vessel 26, while reducing the likelihood of gas contained in the mixing vessel 26 escaping into the atmosphere. The pressure housing also functions to force the compressed air or gas through the perforations 25.

During operation, the shaft is rotated, causing the liquid or material contained in the vessel to be agitated. While the liquid is being agitated, compressed air or gas is simultaneously being provided to the housing 16 via the air inlet 38. The compressed gas enters the housing 16 and is forced through the perforations 25 and into the inner bore 27 of the second shaft section 24. The compressed gas is then delivered to the sparge arrangement of the submerged agitator as indicated by the arrows. The compressed gas then proceeds to the sparge arrangement of the agitator where it is injected into the liquid.

As illustrated in FIG. 1, the compressed gas travels through the second section 24 of the shaft 21, bypassing the gear drive, the shaft support bearings 17 and the coupling 12. As a result, the support bearings are likely not compromised by varying operating temperatures and the resulting varying operating clearances. Furthermore, the likelihood that the bearings will lose clearance if, for example, high temperature excursions do occur, is reduced. The above-described gas pathway will enable bearing selection and spacing to be optimized for each individual application, reducing bearing installation cost. In addition, the bearing clearances are preferably a function of installation procedures and not dependent upon actual shaft operating temperatures as a result to the illustrated air pathway allowing bearing use to be optimized.

Furthermore, lubrication of the gear drive, bearings, etc. is preferably not compromised due to extreme operating temperatures, and the use of an oversized, insulated shaft is likely no longer required. Thus, a greater variety of flexible couplings can be used along with standard gear drive designs. In addition, the apparatus 10 no longer requires use of a rotary joint or a separate shaft seal, reducing manufacturing costs.

Thus, standard components of the agitator drive apparatus 10 can accommodate gas delivery to the submerged agitator. In addition, the gas temperature preferably has little or no impact on the selection and operation of the aforementioned drive apparatus 10 components. Therefore, manufacturing and operating costs are reduced because specialized components and parts, including coolers, are not required, while apparatus 10 reliability is improved.

Figure 2:
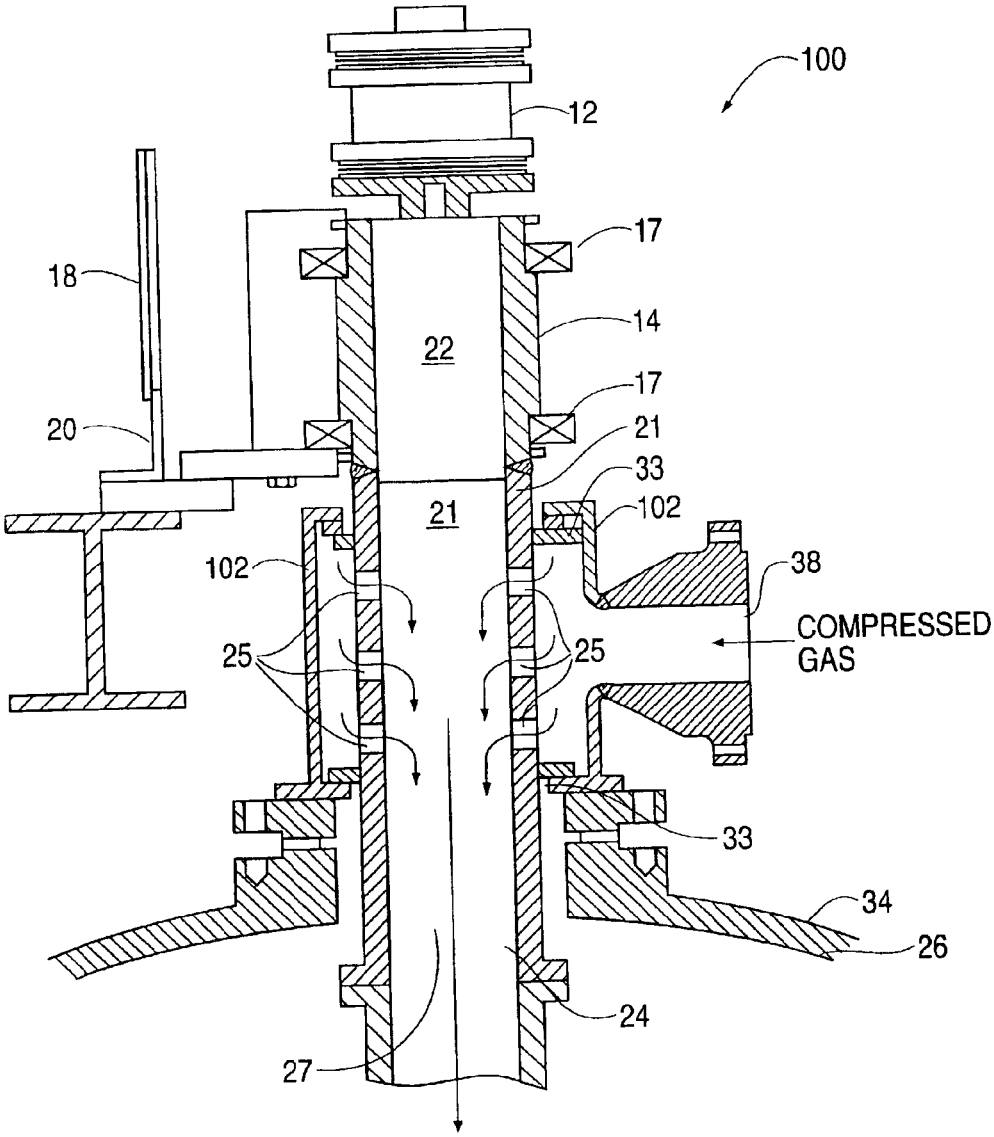
FIG. 2 is a partial cross-sectional view of an agitator and gas injection apparatus in accordance with an alternative embodiment of the present invention.

Referring now to FIG. 2, an agitator drive apparatus 100 in accordance with an alternative embodiment of the present invention is depicted. The apparatus 100 is similar to the previously described embodiment, however it includes a gas sleeve assembly 102 instead of the pressure housing 16 and it does not utilize the attachment assembly 28. The gas sleeve assembly 102 seals the shaft 21 and the drive apparatus 100 to the tank, using commercially available gas seals 33 to seal the upper and lower portions of the sleeve assembly 102. The gas sleeve assembly 102 can be mounted directly to the stud pad on the vessel 26 or attached via the attachment assembly 28 as illustrated in FIG. 1.

The gas seals 33 combine with the sleeve assembly 102 to create an annular sealed space around the shaft 21 while also providing a seal between the vessel 26 and the shaft 21. Preferably, use of the pressure housing 16 eliminates the need for a separate shaft seal. Alternatively, however, a separate shaft seal may be used in combination with the sleeve assembly 102. The sleeve assembly 102 functions to reduce the likelihood of air or gas from the compressor, leaking into the mixing vessel 26, while it reduces reducing the likelihood of gas contained in the mixing vessel 26, escaping into the atmosphere. It also functions to force the compressed air or gas through the perforations 25.

Similar to the embodiment described in FIG. 2, the compressed gas does not pass through the first section 22 of the shaft 21, bypassing gear drive, the shaft support bearings 17 and the coupling 12. Also, like the embodiment depicted in FIG. 1, lubrication of the gear drive, bearings, etc. is not compromised due to extreme temperatures and therefore, an oversized, insulated shaft may not be required. Thus, bearing selections may be optimized and standard gear drive designs utilized along with a variety of flexible coupling types.

Due to the to above-described embodiments illustrated in FIGS. 1 and 2, the cost of manufacturing and operating of the agitator drive and gas injection apparatus is reduced. Gear drives with the minimum sized solid shafts for torque transmission can now be utilized. In addition, since the drive components are not subjected to extreme temperatures, the bearings can be selected based on normal operating temperatures and can be optimized for stiffness and clearance considerations, increasing reliability and operational life. Furthermore, couplings which have traditionally required use of high temperature lubricants to accommodate the elevated temperatures, can now be replaced with non-lubricated designs, reducing the agitator shutdown and maintenance time.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An agitator drive apparatus for agitating and injecting gas into a liquid in a mixing vessel, comprising:

a first housing;

a second housing coupled to said first housing;

a shaft having a first end and a second end, wherein said shaft is rotatably coupled to said first housing and said shaft extends from said first housing into said second housing;

a pair of mounting bellows that extend between said second housing and the mixing vessel, wherein said pair of mounting bellows attach said second housing to the mixing vessel, wherein said shaft has an inner bore extending from said second end at least partially to said first end and said shaft has a plurality of air ports positioned on a portion of said shaft disposed within said second housing, wherein said air ports are in communication with said inner bore, and wherein said second housing comprises a first seal for providing sealing engagement between said first housing, said second housing and said shaft and a second seal for providing sealing engagement between said second housing, said shaft and the mixing vessel.

2. The apparatus according to claim 1, wherein said first seal and second seal are non-contact seals.

3. The apparatus according to claim 2, wherein said non-contact seals are gas seals.

4. The apparatus according to claim 1, wherein said second housing comprises an air inlet.

5. The apparatus according to claim 1, wherein said shaft is rotably coupled to said first housing using at least one bearing.

6. The apparatus according to claim 1, wherein said shaft further comprises a first section disposed within said first housing and a second section coupled to said first section and disposed within said second housing.

7. The apparatus according to claim 6, wherein said inner bore is disposed within said second section.

8. A method for agitating a fluid and injecting gas into a fluid within a mixing vessel, comprising:

rotating a shaft coupled to a liquid agitator, the shaft having a first end, a second end and an inner bore, wherein the inner bore extends from the second end at least partially to said first end, the shaft being coupled to a first housing and extending from the first housing to a second housing, wherein the second housing is coupled to the mixing vessel via bellows, and wherein the shaft includes a plurality of air ports positioned on a portion of the shaft located in the second housing, wherein the air ports are in communication with the inner bore; and delivering gas to the second housing so that the gas enters the air ports and the bore, wherein said second housing comprises a first seal for providing sealing engagement between said first housing, said second housing and said shaft and a second seal for providing sealing engagement between said second housing, said shaft and the mixing vessel.

9. An agitator drive apparatus for agitating and injecting gas into a liquid in a mixing vessel comprising:

a first housing means;

a second housing means coupled to said first housing means;

a pair of mounting bellows that extend between said second housing means and the mixing vessel, wherein said pair of mounting bellows attach said second housing means to the mixing vessel; and an agitator drive means having a first end and a second end, wherein said drive means is rotatably coupled to said first housing means and extends from said first housing means into said second housing means, wherein said agitator drive means has an inner bore extending from the second end at least partially to the first end and said agitator drive means has a plurality of air ports positioned on a portion of said agitator drive means disposed within said second housing means, wherein the air ports are in communication with the inner bore, wherein said second housing means comprises a first seal for providing sealing engagement between said first housing means, said second housing and said rotatable drive means and a second seal for providing sealing engagement between said second housing means, said rotatable drive means and the mixing vessel.

* * * * *